US010633856B2

(12) United States Patent
Leye et al.

(10) Patent No.: US 10,633,856 B2
(45) Date of Patent: Apr. 28, 2020

(54) DRY CONSTRUCTION SYSTEM FOR MAKING PARTITION WALLS, SUSPENDED CEILINGS OR THE LIKE, CARRIER PROFILE THEREFOR, AND USE OF THIS DRY CONSTRUCTION SYSTEM

(71) Applicant: Saint-Gobain Placo SAS, Suresnes (FR)

(72) Inventors: Herbert Leye, Ratingen (DE); Jens Moller, Grefrath (DE); Thomas Riedl, Essen (DE)

(73) Assignee: Saint-Gobain Placo SAS (FR)

( * ) Notice: Subject to any disclaimer, the term of this patent is extended or adjusted under 35 U.S.C. 154(b) by 0 days.

(21) Appl. No.: 14/901,479

(22) PCT Filed: Jul. 1, 2014

(86) PCT No.: PCT/EP2014/063957
§ 371 (c)(1),
(2) Date: Dec. 28, 2015

(87) PCT Pub. No.: WO2015/000897
PCT Pub. Date: Jan. 8, 2015

(65) Prior Publication Data

US 2016/0369500 A1 Dec. 22, 2016

(30) Foreign Application Priority Data

Jul. 1, 2013 (DE) ..... 10 2013 106 880

(51) Int. Cl.
*E04B 2/76* (2006.01)
*E04B 2/74* (2006.01)
(Continued)

(52) U.S. Cl.
CPC ..... *E04B 2/7407* (2013.01); *E04B 2/7412* (2013.01); *E04B 2/7457* (2013.01);
(Continued)

(58) Field of Classification Search
CPC ..... E04B 2/7407; E04B 2/7457; E04B 2/789; E04B 9/245; E04B 2/7412;
(Continued)

(56) References Cited

U.S. PATENT DOCUMENTS 1,918,149 A * 7/1933 Sullivan ..... E04B 1/86 181/207
3,129,792 A * 4/1964 Gwynne ..... E04B 2/60 52/364
(Continued)

FOREIGN PATENT DOCUMENTS

DE 20017095 U1 12/2000
DE 102006021556 A1 7/2007
(Continued)

OTHER PUBLICATIONS

ASTM C645-09a, 6 page PDF, Standard Specification for Nonstructural Steel Framing Members. (Year: 2009).*

*Primary Examiner* — Robert Canfield
(74) *Attorney, Agent, or Firm* — GrayRobinson, P.A.; Michael J. Colitz, III

(57) ABSTRACT

The invention relates to a dry construction system for making partition walls (1), suspended ceilings or the like, with a support structure (2), a cladding (3) arranged on at least one side of this, and an insulation layer (4), wherein the support structure (2) comprises a plurality of carrier profiles (22), to which at least one cladding (3) is secured, and wherein the carrier profiles (22) are formed from a sheet material and exhibit in cross-section a basic section and two limb sections arranged perpendicular thereto, and comprise an embossing with regularly distributed elevations and depressions. In this situation, the centre-to-centre distance between two adjacent elevations of the embossing on one side of the sheet material is less than six times the rated sheet thickness, and the base section is connected to the adjacent
(Continued)

Figure 1:
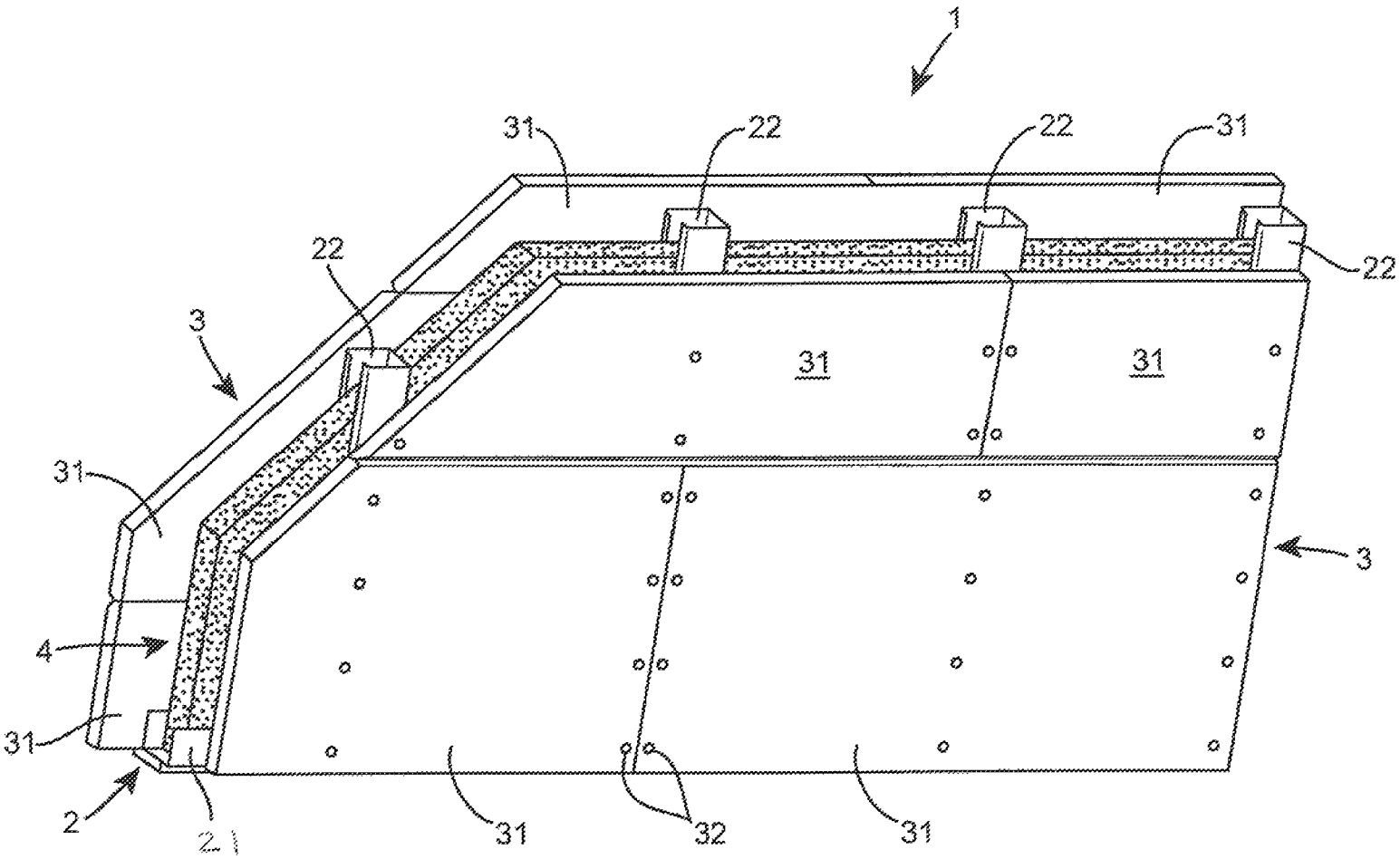

limb section in each case by a curved section with an outer radius which amounts to at least three times the rated sheet thickness. The invention further relates to a carrier profile (22) for such a dry construction system and uses of such a dry construction system. In this way a generic dry construction system is further improved in respect of the sound insulation properties.

19 Claims, 5 Drawing Sheets

(51) Int. Cl.

| | |
|---|---|
| ***E04C 3/04*** | (2006.01) |
| ***E04C 3/07*** | (2006.01) |
| ***E04B 9/24*** | (2006.01) |
| ***E04B 2/78*** | (2006.01) |
| ***E04C 2/284*** | (2006.01) |
| ***E04C 2/32*** | (2006.01) |

(52) U.S. Cl.
CPC ..... *E04B 2/789* (2013.01); *E04B 9/245* (2013.01); *E04C 2/284* (2013.01); *E04C 2/324* (2013.01); *E04B 2002/7477* (2013.01); *E04C 2003/0473* (2013.01)

(58) Field of Classification Search
CPC ..... E04B 2002/7477; E04B 2/56; E04B 5/10; E04C 2/284; E04C 2/324; E04C 2003/0473; E04C 3/07; E04C 3/32; E04F 13/0816; E04F 13/0835; E04F 13/0862
USPC ..... 52/483.1, 266, 475.1, 267, 506.03, 52/506.04, 789.1, 745.09, 745.05, 235, 52/634, 846, 850
See application file for complete search history.

(56) References Cited

U.S. PATENT DOCUMENTS 3,243,930 A * 4/1966 Slowinski ..... E04B 2/7457 52/363
3,553,915 A * 1/1971 Passovoy ..... E04B 2/789 52/241
3,861,493 A * 1/1975 Payne ..... E04B 1/86 181/293
3,950,912 A * 4/1976 Lundberg ..... E04B 1/82 52/144
4,011,704 A 3/1977 O'Konski
4,152,878 A * 5/1979 Balinski ..... E04B 1/941 52/481.1
5,245,811 A * 9/1993 Knorr ..... E04B 2/7409 403/382
5,285,615 A * 2/1994 Gilmour ..... E04B 2/7412 52/781
5,450,806 A * 9/1995 Jean ..... B63B 25/16 114/74 A
5,689,990 A * 11/1997 Deeley ..... B21D 13/04 52/630
5,787,651 A * 8/1998 Horn ..... E04B 2/7412 52/144
5,970,672 A * 10/1999 Robinson ..... E04B 1/14 52/270
6,047,519 A * 4/2000 Bagn ..... E04C 2/384 52/656.1
6,205,740 B1 * 3/2001 Ekerholm ..... E04C 3/09 29/897.312
6,381,916 B1 * 5/2002 Maisch ..... E04B 2/7411 52/481.1
D566,299 S * 4/2008 Mann ..... D25/121
D618,365 S * 6/2010 Crane ..... D25/121
D621,964 S * 8/2010 Zadeh ..... E04B 2/767 D25/121
D709,629 S * 7/2014 Rice ..... D25/125
9,010,070 B2 * 4/2015 Darr, III ..... E04B 2/7457 52/481.1
9,657,481 B2 * 5/2017 Florenske ..... E04F 13/0812
2003/0154686 A1 * 8/2003 Platt ..... E04B 9/061 52/506.05
2005/0081477 A1 * 4/2005 St. Quinton ..... E04B 2/7881 52/846
2006/0185315 A1 * 8/2006 Walker ..... E04B 2/7412 52/837
2007/0209317 A1 * 9/2007 Jensen ..... B05D 7/14 52/834
2007/0245679 A1 * 10/2007 Conville ..... E04B 2/7457 52/712
2008/0006002 A1 * 1/2008 Strickland ..... E04C 3/07 52/843
2008/0110126 A1 * 5/2008 Howchin ..... E04C 3/07 52/630
2008/0250738 A1 * 10/2008 Howchin ..... E04B 2/789 52/235
2009/0013633 A1 * 1/2009 Aubuchon ..... B21D 13/02 52/634
2009/0113827 A1 * 5/2009 Stone ..... E04C 3/07 52/846
2009/0113845 A1 * 5/2009 Knauf ..... E04C 3/07 52/846
2009/0113846 A1 * 5/2009 Knauf ..... E04B 2/789 52/846
2009/0126315 A1 * 5/2009 Knauf ..... E04C 3/07 52/846
2009/0178363 A1 * 7/2009 Pilz ..... E04B 1/24 52/710
2009/0178369 A1 * 7/2009 Pilz ..... E04B 1/24 52/781.3
2009/0223167 A1 * 9/2009 Anderson ..... E04B 2/7457 52/849
2009/0249743 A1 * 10/2009 Bodnar ..... E04C 3/09 52/846
2010/0083606 A1 * 4/2010 Davis ..... E04B 1/24 52/656.9
2010/0223870 A1 * 9/2010 Betts ..... B32B 15/08 52/309.1
2010/0281821 A1 * 11/2010 Frobosilo ..... E04C 3/09 52/846
2014/0165499 A1 * 6/2014 Vanker ..... E04C 3/07 52/834
2015/0027514 A1 * 1/2015 Furutani ..... E04C 2/324 136/251
2016/0258176 A1 * 9/2016 Herfurth ..... E04B 1/24
2016/0305115 A1 * 10/2016 Albartus ..... E04B 1/4107
2017/0138048 A1 * 5/2017 Leonard ..... B21D 5/00
2017/0254081 A1 * 9/2017 Castellucci ..... B21D 5/08
2018/0148925 A1 * 5/2018 Rice ..... E04B 2/7457

FOREIGN PATENT DOCUMENTS

DE 102013106880 A1 * 1/2015 ..... E04B 2/7407
EP 0891234 B1 1/2002
EP 2091674 B1 1/2011
EP 2311584 A1 4/2011
FR 2968324 A1 * 6/2012
GB 2302106 A * 1/1997 ..... E04C 3/07
IE 20030355 A1 11/2003
JP S5247848 10/1977
WO 9412294 A1 6/1994
WO 2002006600 A1 1/2002
WO 2006105825 A1 10/2006
WO 2006105826 A1 10/2006
WO WO-2006105826 A1 * 10/2006 ..... E04C 3/07
WO 2007128490 A1 11/2007
WO WO-2007128490 A1 * 11/2007 ..... B21D 13/04

* cited by examiner

DRY CONSTRUCTION SYSTEM FOR MAKING PARTITION WALLS, SUSPENDED CEILINGS OR THE LIKE, CARRIER PROFILE THEREFOR, AND USE OF THIS DRY CONSTRUCTION SYSTEM

CLAIM OF PRIORITY

This application is a continuation of and claims priority under 35 U.S.C. § 371 to International Application No. PCT/EP2014/063957 filed on Jul. 1, 2014, which in turn claims priority to German App. No. 10 2013 106 880.4 filed on Jul. 1, 2013, the contents of which are incorporated herein by reference for all purposes.

The invention relates to a dry construction system for making partition walls, suspended ceilings or the like, with a support structure in the form of a metal carrier structure, a cladding arranged on at least one side of this, and an insulation layer, which is arranged in the region of the support structure, wherein the support structure comprises a plurality of carrier profiles, to which at least one cladding is secured, wherein the carrier profiles are formed from a sheet material and exhibit in cross-section a basic section and two limb sections arranged perpendicular thereto, and wherein the limb sections of the carrier profiles comprise an embossing with regularly distributed elevations and depressions. The invention further relates to a carrier profile for such a dry construction system and the uses of such a dry construction system.

Such dry construction systems are used, as a rule, to make, with low effort in construction and economically, partition walls in residential and utility rooms or also suspended ceilings, etc. The carrier frame of such a dry construction system is based in this situation in most cases on metal profiles with different profile arrangements.

In the case of partition walls, as a rule, first U-shaped profile rails are secured on the floor side and ceiling side in such a way that their free limbs face one another. Carrier profiles made of metal are then inserted into these in positive fit, which run upright, and the profile rails therefore connect the floor and ceiling to one another. These carrier profiles exhibit as a rule a C-shaped or U-shaped profile design. They therefore have in any event a basic section and two limb sections perpendicular thereto. First, secured by screws to these limb sections, in order to erect such a partition wall, is a cladding, as a rule made of gypsum plasterboard panels. Next, an insulation layer is introduced into the partition wall, which is arranged in the region of the support structure and therefore in the plane thereof. As insulation material, use is made mostly of mineral wool. In addition to this, electrical installations or the like can also be laid in the partition wall. Next, a further cladding is secured to the still open side of the dry construction system by means of screws. The fixing is carried out in turn at limb sections of the carrier profiles. The insulation layer is therefore accommodated between the two claddings.

If it is intended that a partition wall should be formed with a double cladding, for this purpose a second layer of the cladding is arranged on both sides, offset to the first layer. There is also the application situation of a double single-plank wall, with which, in particular in order to increase the thickness of the insulation, two carrier profiles are arranged next to one another between the claddings.

In the case of suspended ceilings, the carrier profiles are, as a rule, first secured directly or by means of retaining profiles to the rough ceiling. Next, the insulation layer is introduced into this region. Finally, facing is also provided here by a cladding on the underside of the ceiling structure, wherein the gypsum plasterboard panels or the like used for this purpose are screwed to the limb section allocated to them of the respective carrier profile.

A partition wall or suspended ceiling formed in this way can be given an aesthetically appealing appearance by the filling of the joints or screw holes over the sunken screw heads, with a subsequent surface refinement by a coating, a wallpaper, or the like.

Apart from this, however, it is also possible in this way to achieve an efficient thermal and sound insulation effect. The insulation layer makes a substantial contribution to this. It has been shown, however, that the support structure, necessarily incurred by the system, forms a kind of sound bridge, such that the sound insulation values which can be achieved are limited. Accordingly, some systems have already been developed with which it is intended that the sound insulation effect should be improved.

One example of this can be found in the wall profile serving as a carrier profile in accordance with DE 200 17 095 U1. This is formed from galvanised steel and is used as the support structure for gypsum plasterboard single-plank walls. A characteristic in this situation is that protrusions of point and/or papillate form in the limb sections of the carrier profiles, which serve as a contact surface for the gypsum plasterboard panels etc. which are to be fitted. In this way, the contact surface for the cladding is minimised, as a result of which the sound transfer between the rooms is intended to be reduced.

A further example of such a carrier profile is derived from WO 2007/128490 A1. This may exhibit a C-shaped or U-shaped profile design. Here too, projections on the surface incurred by embossing are formed on the surface of at least the limb sections, and in one embodiment also at the base section. The surface, which in this case is embossed in free form, does not exhibit any surface sections running in the original plane of the sheet material, and instead has inclined sliding surfaces in all regions which interact with the screws serving to provide securing. These securing means can therefore in each case slide into the next indentation and be screwed in there. In this way, the screws are always arranged at precisely defined positions and engage there, without any additional effort being required for this. This accordingly simplifies the assembly and installation of the dry construction system.

For the design of such embossed elements, various different methods and embossing processes are known. Examples of these are found in the documents WO 94/12294 A1, EP 0 891 234 B1, EP 2 091 674 B1 and EP 2 311 584 A1. These texts are concerned in each only with the method of producing such embossings, however, and not with the question of sound protection in a dry construction system.

By contrast, the aim of the carrier profile according to the document WO 2006/105825 A1 is to improve the sound insulation effect. For this purpose, provision is made for the opening angle of a limb section in relation to the base section to be set at a value greater than 90°. According to the teaching of this document, this is intended to have an advantageous effect on the sound insulation properties. A further improvement of the sound protection is achieved according to this prior art by the arrangement of beading in the limb sections. Moreover, by the formation of a special type of embossing, namely a knurling, on the surface of the sheet material, it is intended, in combination with the beading and the special opening angle of the limb sections, to achieve further improvements in respect of the base section with regard to the sound insulation properties.

The same purpose of improving sound protection is also the aim of the text WO 2006/105826 A1. With this alternative solution to the protective rights applications discussed heretofore, provision is made for the sound insulation properties to be improved in that beadings projecting outwards are arranged on the contact surface to the cladding. As a result, the contact surface of the gypsum plasterboard panels or the like can be kept correspondingly small, and amounts, for example, to between 5% and 25%. In this situation, according to the teaching of this document, it is likewise advantageous with regard to the sound insulation properties, if the sheet material of the carrier profile exhibits a knurling on at least a part of its surface.

The special embodiment proposed here for the carrier profiles has proved in practice to be entirely advantageous in respect of the sound insulation properties. Nevertheless, the sound insulation values which can be achieved with this are, as before, no more than adequate with regard to today's requirements for such dry construction systems.

The invention is therefore based on the object of further improving the sound insulation properties of generic dry construction systems.

This object is solved by a dry construction system with the features of claim 1. This is characterised in particular by the fact that the base section of the carrier profile also exhibits an embossing with regularly distributed elevations and depressions, that the centre-to-centre spacing between two adjacent elevations of the embossing on one side of the sheet material is less than six times the rated sheet thickness, and that the base section is connected with the adjacent limb section by way of a curved section with an outer radius which is less than three times the rated sheet thickness.

According to the invention, it has therefore been recognised that a further improvement in sound insulation properties can be achieved in that, as a departure from the structural design solutions according to WO 2006/105825 A1 and WO 2006/105826 A1, not only the limb sections, but also the base section of the carrier profiles is provided with an embossing of regularly distributed elevations and depressions, and in this situation a specific centre-to-centre distance between two adjacent elevations is selected which is less than a predetermined value. In interaction with the minimum radius specified in the claim for a curved section at the connection between the base section and the adjacent limb section in each case, this results in a favourable sound technology behaviour of the carrier profiles inside the system as a whole, due to the particularly advantageous sound insulation properties. The rated sheet thickness is the thickness or material thickness of the rough sheet before the embossing step in accordance with DIN 18182-1, 2007-12.

As practical tests have shown, as a result of this, in particular, the conducting of sound specifically in the curved section between the base section and the adjacent limb section is advantageously influenced according to the invention. In this situation, this takes place in interaction with the embossing. The minimum radius specified according to the invention in the curved section with, at the same time, a defined maximum centre-to-centre distance between the elevations of the embossing leads to the elements of the embossing also being subject to relatively little distortion in the region of the curved section as a result of the bending process. As a result, the embossing can also exert a positive influence on the sound insulation behaviour specifically in this region.

From the practical tests it has also transpired that the specially selected arrangement according to the invention of the embossing at the limb sections of the carrier profiles interacts advantageously with the cladding arranged thereon. Due to the resultant small-area configuration of the contact surfaces between the cladding and the structured surface of the allocated limb section, a particularly advantageous degree of sound insulation is achieved.

The structural design embodiment of the carrier profiles selected according to the invention with an otherwise conventional dry construction system therefore surprisingly allows for a perceptible improvement in the sound protection properties of the system as a whole. In practical tests, improvements of 4 dB and more have been measured in comparison with conventional partition wall systems which are otherwise of identical design.

In this situation it is of further advantage that carrier profiles with such a structural design can be prepared with relatively little technical manufacturing effort. For the production of the embossing, all that is required is for an appropriate embossing roller or the like to be provided, by means of which the sheet material for the carrier profiles can be manufactured in large series volumes. For the formation of the curved section with the minimum outer radius provided for according to the invention, all that is required is for a bending device to be specified accordingly. The technical manufacturing efforts for the production of the carrier profiles provided according to the invention is therefore minor, and not greater than the prior art. These carrier profiles can therefore be provided with savings of costs, efficiently, and also with savings of materials. Accordingly, the dry construction system as a whole can be produced economically and efficiently.

It has accordingly proved advantageous in practical tests if the centre-to-centre distance between two adjacent elevations of the embossing on one side of the sheet material amounts to at least three times the rated sheet thickness. This lower limit for the strip width of the centre-to-centre distance therefore reproduces the structural design situation in which the force required for the embossing process can be kept comparatively low. Accordingly, the requirements on the embossing machine lie within a manageable and reasonable framework. In addition, with this minimum distance interval between the elevations of the embossing, it can essentially be ensured that individual surface sections of the surface of the embossed profile are not deflected in an inclined alignment, out of the position which is desirable from the point of view of sound technology, parallel to the surface of the non-embossed sheet strip. Accordingly, in the embossed surface there are also surface sections present between the elevations which are aligned parallel, i.e. not inclined to the main plane of the respective section on the carrier profile. Particularly favourable sound insulation properties as well as technical manufacturing conditions can be achieved in this situation in particular with a centre-to-centre distance of between four times and 5.5 times the rated sheet thickness.

Moreover, the basic section can be connected to the adjacent limb section in each case by a curved section with an outer radius which amounts to a maximum of ten times the rated sheet thickness. As a result of this upper limit, the strip width for the outer radius is specified within which the sound insulation properties can be improved particularly favourably in comparison with the prior art. Even better properties for the sound insulation effect are attained with an outer radius of the curved section which lies between six times and seven times the rated sheet thickness, as practical tests have shown.

It is of further advantage if the base section comprises at least one beading running longitudinally. It has been shown in this situation that, as a result of this beading, not only is the torsional behaviour of the carrier profile improved, and therefore the mechanical properties, but also further improvements are achieved in respect of the sound insulation properties. Even if the effect interactions associated with this are not yet fully clarified, it can in any event be recognised that, due to a beading, evidently also in interaction with the likewise provided embossing, an impediment to the conducting of sound is imposed, which has a particularly advantageous effect on the sound insulation properties. In this situation it is preferable if precisely one beading is formed in the middle in the base section. In practical tests it has been shown that essentially no further improvement can be achieved if a plurality of beadings are provided in the base section, while the manufacturing effort would be increased if a plurality of beadings were to be included in the embodiment.

If the two limb sections in each case exhibit a beading running longitudinally, the sound insulation properties can likewise be further improved. Here too, there is an evident impediment to the conducting of sound in interaction with the embossing. It is particularly preferable in this situation if in each case precisely one beading is arranged in the middle in each beading section, since an especially good sound insulation effect can be thereby achieved with little technical manufacturing effort.

In this situation it is of advantage if the beading projects to the inner side of the profile cross-section. In this respect, too, practical tests have shown that further positive effects can be thereby achieved with regard to reduced conducting of sound.

Particularly good results have been achieved in this situation with regard to technical sound aspects if a depth of the beading amounts to one to six times the rated sheet thickness.

It has further proved advantageous in respect of the sound insulation effect if the beading exhibits an essentially triangular-shaped cross-section and at the apex encloses an interior angle of some 90°.

The sound insulation properties of the dry construction system according to the invention can be further improved if the embossing in the carrier profiles is applied on both sides. As a result of this it is possible, for example in comparison with a knurling, which represents an embossing on one side, to achieve particularly favourable influences to reduce the conducting of sound.

In a further embodiment, it is also possible for the carrier profiles to exhibit at the free ends of the limb sections in each case a tilt inclination facing inwards. The carrier profiles are then essentially C-shaped in form, and exhibit improved mechanical properties. It has been shown that at the same time this incurs good sound insulation properties.

If a total thickness of the profiled base section or of the profiled limb sections exhibits 1.2 to three times the rated sheet thickness, improved sound insulation properties are again achieved, as practical tests have shown. This thickness is derived in this case by the embossing depth in the sheet material, and can therefore be adjusted with simple means in the course of the manufacturing process. This results in a particularly favourable disruption of the sound conductance, such that the sound insulation effect can be further improved. This is the case in particular if the total thickness amounts to some 1.6 times the rated sheet thickness from which the carrier profile was originally manufactured, as has been shown in practical tests.

According to a further aspect of the present invention, according to claim 12, a carrier profile is provided for the dry construction system according to the invention. This represents a constituent part of the dry construction system which can be dealt with independently, and is characterised by the special structural design features explained heretofore. This carrier profile accordingly forms the basis for the improvement in terms of sound technology of the dry construction system according to the invention. The advantages explained heretofore with regard to the dry construction system according to claim 1 are therefore made possible by the carrier profile.

In this situation, the further embodiments are possible in respect a carrier profile according to the invention, such that the corresponding advantages can be achieved.

According to a further aspect of the present invention the use of a dry construction system according to the invention is provided for with regard to the production of a dry construction partition wall. The dry construction partition wall created in this way therefore exhibits improved sound insulation properties and is characterised in particular by the further advantages explained in detail heretofore.

As an alternative to this, provision is also made for the use of a dry construction system according to the invention for the production of a suspended ceiling, whereby likewise the advantages explained heretofore are achieved in particular with regard to the sound insulation properties.

Figure 2:
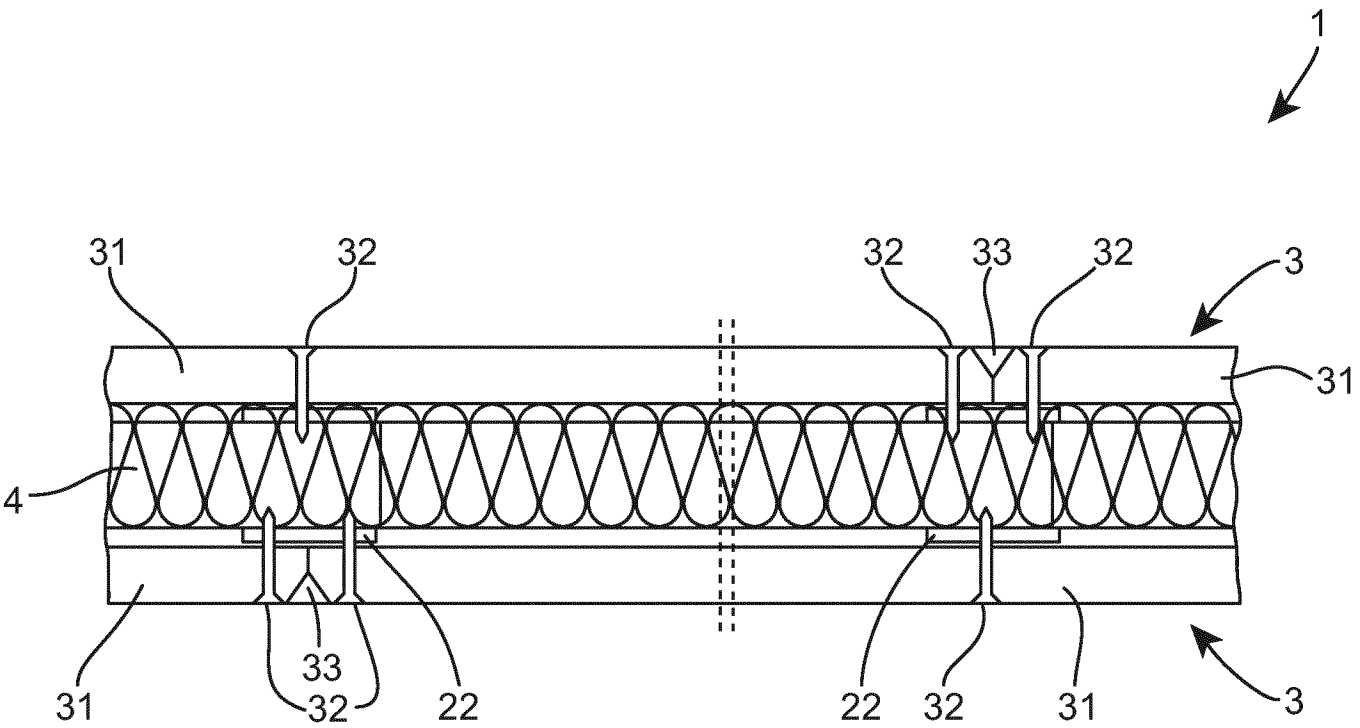
Figure 4:
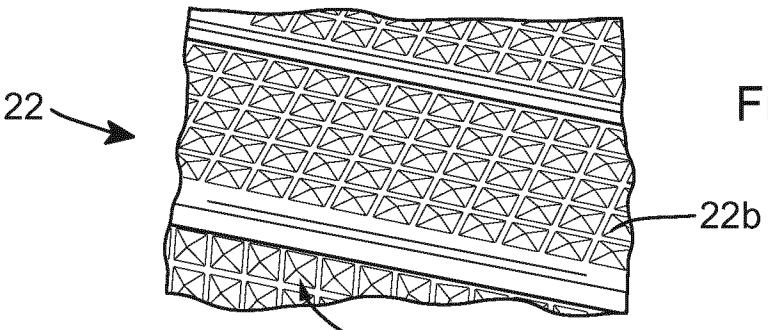
Figure 3:
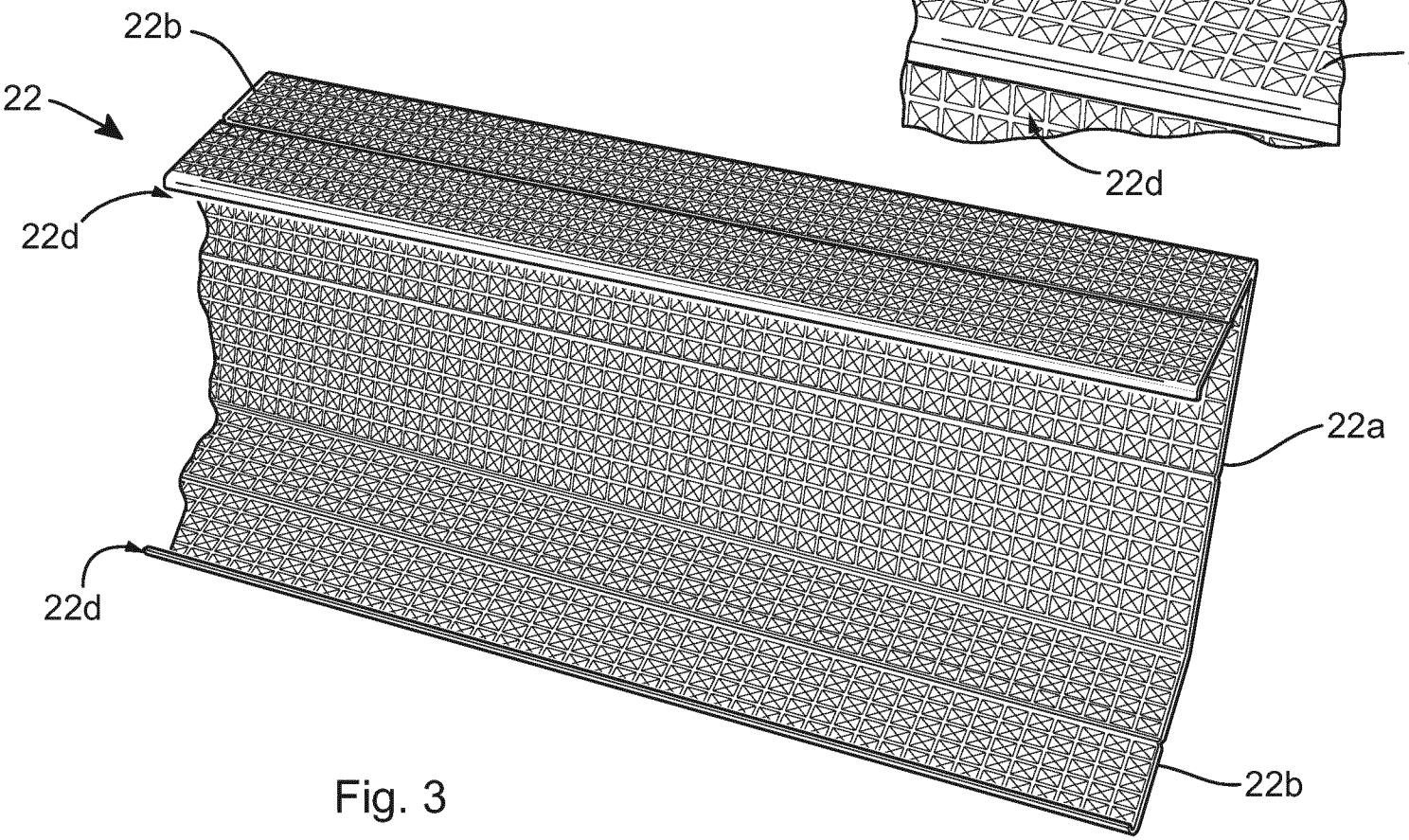
Figure 5:
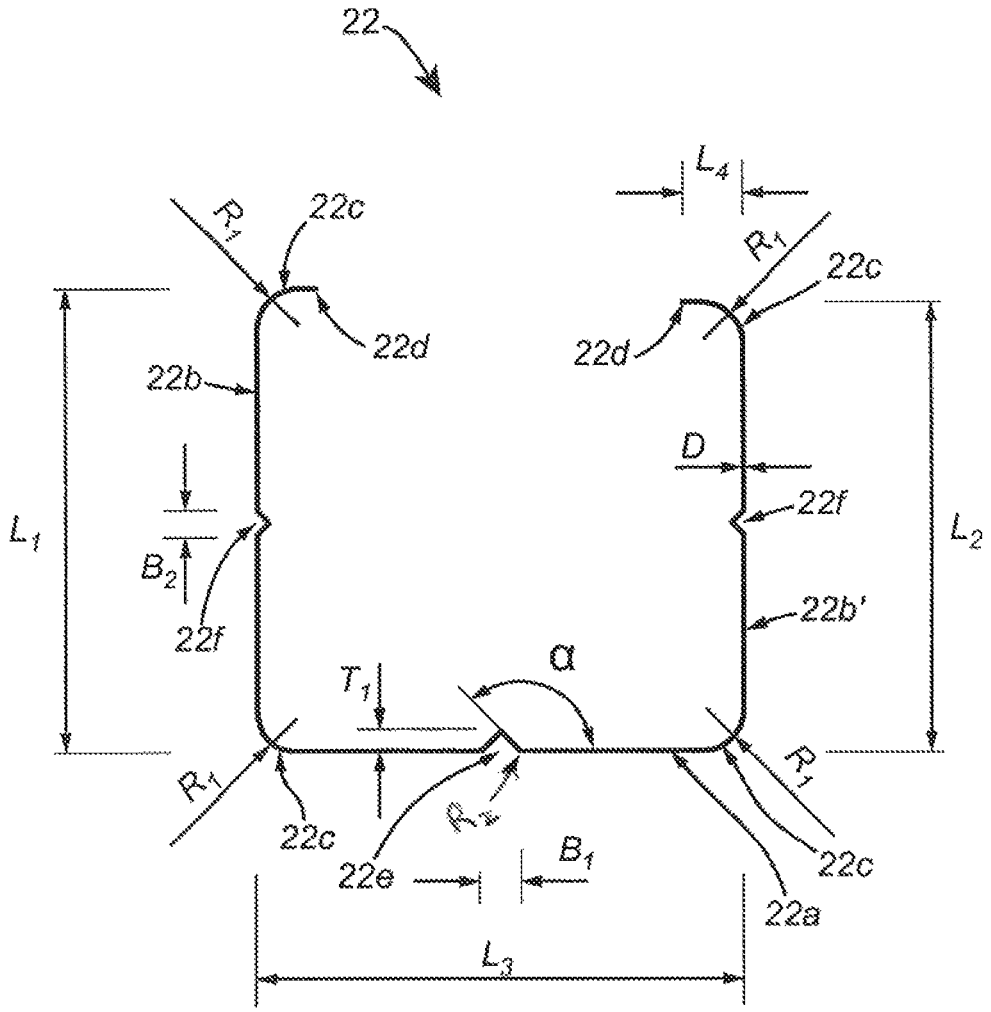
Figure 6:
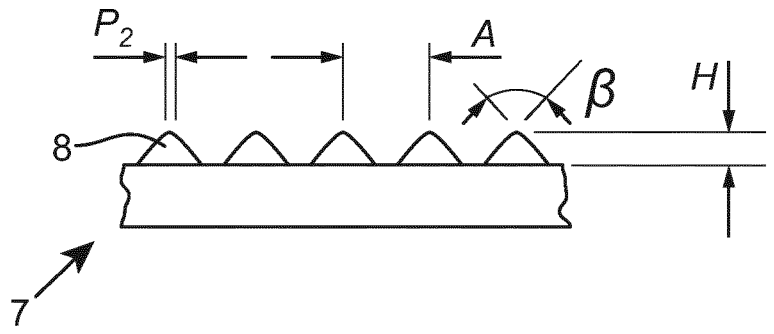

The invention is explained in greater detail hereinafter by way of embodiments, based on the figures in the drawings. These show:

FIG. 1. a perspective view of a partition wall in dry construction format, shown in a partial sectional view;

FIG. 2. a section from a horizontal section through the partition wall in FIG. 1;

FIG. 3. a perspective view of a carrier profile;

FIG. 4. an enlarged detail representation of the surface of the carrier profile according to FIG. 3;

FIG. 5. a transverse view of a carrier profile according to the invention;

FIG. 6. a side view of a section of the surface of an embossing roller; and

Figure 7:
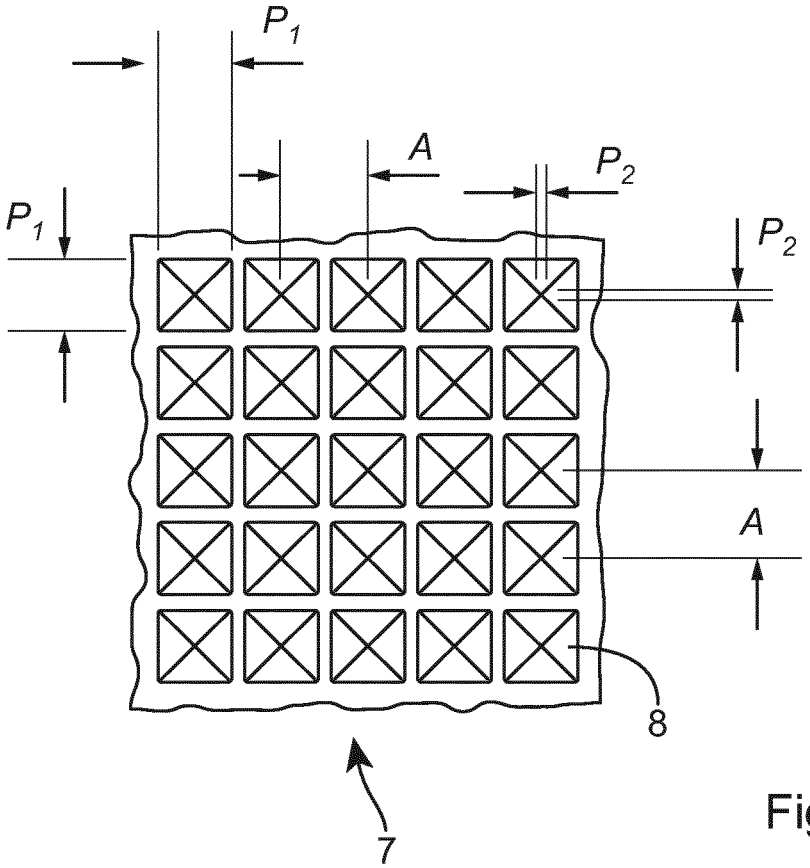

FIG. 7. a view from above onto the section of the embossing roller according to FIG. 6.

According to the representation in FIG. 1, a partition wall 1, which is designed as a single-plank wall with simple facing, comprises a support structure 2 in the form of a metal carrying structure, which is faced on both sides with a cladding 3. The cladding 3 on both sides encloses between it an insulation layer 4 made of mineral wool, located in the plane of the support structure 2.

The support structure 2 exhibits an essentially U-shaped floor profile 21, which is secured beforehand on the floor side when the partition wall 1 is produced. A correspondingly designed ceiling profile, not shown here, extends parallel to and perpendicular above the floor profile 21, at the ceiling of the room, not shown here. Arranged between the floor profile 21 and the ceiling profile are a plurality of carrier profiles 22, made of galvanised steel, which in each case extend upright at predetermined distance intervals.

The carrier profiles 22 serve to secure the cladding 3. This comprises a plurality of gypsum plasterboard panels 31, which in each case are secured by means of screws 32 to the carrier profile 22. In this situation, self-tapping screws 32 are used. As can be seen from FIG. 1, the gypsum plasterboard panels 31 exhibit a length which corresponds to double the distance between two carrier profiles 22. As a result, an offset arrangement of the gypsum plasterboard panels 31 is possible, in the manner shown.

Shown in FIG. 2 is a horizontal section through the partition wall 1 according to FIG. 1. As can be seen from this, the gypsum plasterboard panels 31 are screwed directly to the carrier profiles 22. These are formed as single pieces, and comprise a base section 22*a* as well as two limb sections 22*b* and 22*b*' respectively, located essentially perpendicular to this, as can be seen in greater detail from FIGS. 3 and 5. The base section 22*a* in this situation extends transverse to the plane of the wall, and connects the two claddings 3. These are connected, in the manner shown in FIG. 2, in each case to a limb section 22*b* and 22*b*' respectively, by the screws 32. Inasmuch as two gypsum plasterboard panels 31 abut one another in the region of a carrier profile 22, their edges are secured in each case by means of screws to the same limb section 22*b* and 22*b*' respectively. Inasmuch as a limb section 22*b* or 22*b*' respectively comes to lie in the middle region of a gypsum plasterboard panel 31, as a rule one single screw in the horizontal direction is sufficient for the securing.

In FIG. 2 it can further be seen that the joints between two abutting plasterboard panels 31, in the same way as the screw holes with the screw heads slightly sunk in the conventional manner, can be filled out with a filler compound 33. This results in a flat outer surface of the partition wall 1.

In FIGS. 3 to 5 a carrier profile 22 is shown in greater detail.

As can be seen in particular from the cross-sectional view in FIG. 5, the two limb sections 22*b* and 22*b*' respectively are connected in each case by a curved section 22*c* to the base section 22*a*. The carrier profile 22 further exhibits a tilt inclination 22*d*, which is likewise connected by a curved section 22*c* to the free end of the respective limb section 22*b* and 22*b*' respectively. The carrier profile 22 therefore exhibits an essential C-shaped design.

In the embodiment shown, the entire surface of the carrier profile 22 is provided with embossing of regularly distributed elevations and depressions. In FIG. 4 these are shown in an enlarged representation. The embossing is in this situation applied from both sides, such that the elevations and depressions are arranged offset to one another on two large surfaces of the carrier profile 22.

The carrier profile 22 further exhibits a beading 22*e* in the base section 22*a*. This beading 22*e* is arranged in the middle in the base section 22*a*. In addition, the carrier profile 22 in each limb section 22*b* and 22*b*' respectively comprises a beading 22*f* which is likewise arranged in the middle.

In the embodiment shown, a limb length $L_1$ of a limb section 22*b* is dimensioned at 48.5 mm. A limb length $L_2$ of the other limb section 22*b*', by contrast, exhibits a dimension of 47 mm. Due to these differently dimensioned limb lengths of the limb sections 22*b* and 22*b*' respectively, two such carrier profiles 22 fit inside one another for transport, as a result of which transport volume is saved.

A base length $L_3$ of the base section 22*a* exhibits in this case a dimension of 48.8 mm. An inclination dimension $L_4$ of the inclinations 22*d* is in each case dimensioned at 6 mm. A radius $R_1$ of the curved section 22*c* in the embodiment shown here exhibits in each case a value of 4 mm. This is the outer radius of the curved section 22*c* between the base section 22*a* and the respective limb section 22*b* and 22*b*' respectively and a limb section 22*b* and 22*b*' respectively, and the tilting inclination 22*d* allocated in each case.

The beading 22*e* in the base section 22*a* exhibits in this case a depth $T_1$ of 2.5 mm. The beading 22*e* has in this situation an essentially triangular-shaped cross-section, wherein the flanks of this extend opposite the base section 22*a* at an angle $\alpha$ of 135°. The angle enclosed by the triangular formation of the beading 22*e* accordingly amounts to 90°. The flanks of the beading 22*e* are additionally tilted with a radius $R_2$ of 1 mm from the base section 22*a*. A width $B_1$ of the beading 22*e* in the base section 22*a* has a dimension of 4.7 mm.

The beading 22*f*, which in each case is formed in the middle in the limb section 22*b* and 22*b*' respectively, exhibits a width $B_2$ of 3.5 mm. This is in each case formed less deep than the beading 22*e* in the base section 22*a*.

The beadings 22*e* and 22*f* in this situation project in the manner shown in FIG. 5 towards the inner side of the profile cross-section of the carrier profile 22.

The carrier profile 22 shown in FIG. 5 corresponds to what is referred to as a CW50 profile. In this situation, carrier profiles with other standard dimensions are usual, wherein the difference relates in particular to the base length $L_3$. With a profile CW75, for example, this can have a dimension of 73.8 mm, with a profile CW100 a dimension of 98.8 mm, with a profile CW125 a dimension of 123.8 mm, and with a profile CW150 a dimension of 148.8 mm.

As can be seen in particular from FIG. 4, the embossing also extends over the curved sections 22*c* and, despite the bending process, continues to be embossed there. This is particularly associated with the fact that the distance interval between two adjacent elevations of the embossing is relatively small in comparison with the radius $R_1$ of the curved section 22*c*. In the embodiment shown, the centre-to-centre distance between two adjacent elevations is 2.7 mm. With the rated sheet thicknesses in the embodiment shown, i.e. the thickness of the unfinished sheet before the embossing step, of 0.6 mm, a factor of 4.5 is derived, i.e. the centre-to-centre distance between two adjacent elevations of the embossing is 4.5 times the rated sheet thickness.

A total thickness D of the profiled sheet material of the carrier profile 22 in the embodiment shown is about 1 mm.

In FIGS. 6 and 7, by way of illustration, a section from the surface of a suitable embossing roller 7 is shown. As can be seen from this, embossing teeth 8 essentially exhibit the shape of a truncated pyramid. The embossing teeth 8 in this situation exhibit a width $P_1$ of the base, which in the embodiment shown amounts to 2.20 mm. A width $P_2$ of the embossing teeth level at the upper end of the truncated pyramid is dimensioned here at 0.20 mm. A distance interval A between two embossing teeth 8 is 2.70 mm, from which is derived on the embossed surface of the carrier profile 22 the centre-to-centre distance referred to heretofore, with a dimension of 2.70 mm. A height H of an embossing tooth 8 is dimensioned here at 1.00 mm. A flank angle $\beta$ of the embossing tooth 8 in the embodiment shown is 90°.

The embossing teeth 8, of which, for easier overview, only one single tooth is shown in FIGS. 6 and 7 respectively, are arranged regularly on the surface of the embossing roller 7, and therefore create regularly distributed indentations in the carrier profile 22. In this situation, for the embossing of the carrier profile 22, two such embossing rollers 7 with a slight gap between them are moved in counter-rotation to each other in such a way that the sheet material is drawn between them and subjected to an essentially full-surface press-embossing. As a result, not only is the simultaneous formation of elevations and indentations of the embossing achieved, but also that a part of the surface of the sheet material which is not subjected directly to the embossing teeth 8 continues to remain parallel to the original orientation of the non-embossed material. The embossing process used in the course of the present invention corresponds essentially to the method derived from WO 94/12294 A1.

Practical tests with partition walls 1 according to the invention have revealed that insulation values can be achieved which are better than the prior art. For example, with the use of a profile in the design according to FIG. 5, but with a base length $L_3$ of 73.8 mm, i.e. a CW75 profile, with a rated sheet thickness of 0.6 mm and a centre-to-centre distance of 2.7 mm, in each case with a beading 22*e* and 22*f* arranged in the middle and a cladding made of RB panels of Rigips with a weight per unit area of approx. 8.7 kg/m$^2$ with a thickness of 12.5 mm of the cladding, a calculated value RWJR for the sound insulation of 43 dB is achieved. If a double facing is used, i.e. a two-layer cladding 3 on both sides of the partition wall 1, and otherwise the same structure, a calculated value $R_{W,R}$ for the sound insulation of 54 dB is even achieved.

A partition wall 1 designed according to the invention therefore exhibits excellent sound insulation properties.

The invention also allows for further design formulations in addition to the embodiment explained.

For example, the centre-to-centre distance between two adjacent elevations of the embossing on one side of the sheet material is not restricted to the value referred to heretofore of 2.70 mm. Rather, it can lie in particular in the range between three times and six times the rated sheet thickness without any substantial deterioration with regard to the sound insulation effect being anticipated.

Moreover, the outer radius of the curved section need not necessarily amount to 4 mm, as in the embodiment shown. As has been shown, a radius here of between three times and ten times the rated sheet thickness is, as a rule, suitable for achieving good sound insulation properties.

As well as this, it is not necessary for the base section 22*a* to comprise only one single beading 22*e* running longitudinally. In a number of exemplary embodiments, such as, in particular, with the use of a U-shaped profile, two or more beadings may also be provided in the base section 22*a*.

It is accordingly not necessary for the inclinations 22*d* to be provided in the carrier profile 22. This then exhibits the essentially U-shaped form referred to heretofore.

The total thickness of the profiled carrier profile 22 does not necessarily amount to 1 mm, as in the embodiment shown. In particular, with the use of a U-shaped profile, a total thickness of, for example 0.8 mm, can be sufficient in this situation. In general it has been shown that this total thickness should exhibit between 1.2 times and three times the rated sheet thickness.

In simplified embodiments, it is also possible to do without the beading in the base section and/or in the two limb sections.

The dimensions of the beadings can additionally vary from those illustrated. They may be identical, or, as shown in FIG. 5, they may exhibit different dimensions. In general, a depth of the beading of between one to six times the rated sheet thickness has proved favourable.

The cross-section formation and the width or a possible interior angle at the apex of the respective beading can be adjusted in a suitable manner to the respective application situation. In particular, it is therefore possible for the beading to be designed not as triangular but as a semi-circle.

In addition, it is not absolutely necessary for the die embossing in the carrier profiles 22 to be introduced on both sides. In a simplified embodiment, it would also be possible for the embossing to be applied only on one side, for example in the form of knurling.

As well as this, the embossing need not necessarily be formed as full-surface on the carrier profile. For example, it is possible for a structuring of the surface of the inclinations to be done without.

Moreover, the regular structure of the embossing can also lead to a repeating pattern being embossed.

As cladding 3, as well as the RB gypsum plasterboard panels referred to, use may also be made, for example, of a Duraline panel, exhibiting a weight per unit area of approx. 13 kg/m$^2$ at a thickness of 12.5 mm. This allows for the sound insulation effect to be again perceptibly improved.

Alternatively, for the cladding 3, other construction panels can be used, such as, for example, wood fibre panels etc.

The insulation layer 4 can also be formed from a material other than mineral wool. Fibre insulation materials of other kinds may be used, or also foamed plastics, etc.

With the system according to the invention, not only can partition walls 1 be produced, but also other dry construction elements, such as, in particular, suspended ceilings or the like. In this case, the cladding 3 is done away with on one side. Such suspended ceilings are used not only in the horizontal ceiling region, but also on roof pitches or the like.

The invention claimed is:

1. Dry construction system for making partition walls (1) or suspended ceilings comprising:

a support structure (2) in the form of a metal load-bearing structure, the support structure having a plane, at least one cladding (3) arranged on at least one side of the support structure (2), and an insulation layer (4), which is arranged in the plane of the support structure (2), wherein the support structure (2) comprises a plurality of carrier profiles (22), to which the at least one cladding (3) is secured, wherein the carrier profiles (22) are formed from a sheet material having a rated sheet thickness and comprise in the cross-section a base section (22*a*) as well as two adjacent limb sections (22*b*, 22*b*') arranged perpendicular to the base section (22*a*), and wherein the limb sections (22*b*, 22*b*') of the carrier profiles (22) comprise an embossing with regularly distributed elevations on a first surface and corresponding depressions on a second, opposing surface, characterised in that the base section (22*a*) of the carrier profile (22) also comprises the said embossing with regularly distributed elevations on a first surface and corresponding depressions on a second, opposing surface, said elevations and depressions regularly distributed in an orthogonal array, so as to provide a pattern that repeats in two dimensions, the elevations having centre-to-centre distances, wherein the centre-to-centre distance between two adjacent elevations of the embossing on the first surface of the sheet material is between three and six times the rated sheet thickness, and that the base section (22*a*) is connected to the adjacent limb section (22*b*, 22*b*') in each case by means of a curved section (22*c*) with an outer radius (R1) which amounts to between three and ten times the rated sheet thickness.

2. Dry construction system according to claim 1, characterised in that the centre-to-centre distance between the two adjacent elevations of the embossing on one side of the sheet material amounts to three times the rated sheet thickness.

3. Dry construction system according to claim 2, characterised in that the centre-to-centre distance between two adjacent elevations of the embossing on one side of the sheet material lies between four times and 5.5 times the rated sheet thickness.

4. Dry construction system according to claim 1, characterised in that the curved section (22*c*) with an outer radius (R1) amounts to ten times the rated sheet thickness.

5. Dry construction system according to claim 4, characterised in that the outer radius (R1) of the curved section (22*c*) is between six times and seven times the rated sheet thickness.

6. Dry construction system according to claim 1, characterised in that the base section (22*a*) comprises at least one beading (22*e*) running longitudinally.

7. Dry construction system according to claim 6, characterised in that the beading (22*e*) of the base section projects to an inner side of the carrier profile cross-section.

8. Dry construction system according to claim 6, characterised in that a depth of the beading (22*e*) of the base section amounts to one to six times the rated sheet thickness.

9. Dry construction system according to claim 6, characterised in that the beading (22*e*) exhibits a triangular cross-section with an apex, wherein the apex encloses an inner angle of approximately 90°.

10. Dry construction system according to claim 6, wherein precisely one beading (22*e*) is arranged in the middle in the base section (22*a*).

11. Dry construction system according to claim 1, characterised in that the two limb sections (22*b*, 22*b*') comprise in each case a beading (22*f*) running longitudinally.

12. Dry construction system according to claim 11, wherein in each case precisely one beading (22*f*) is arranged in the middle in each limb section (22*b*, 22*b*').

13. Dry construction system according to claim 11, wherein the carrier profile cross-section includes an inner side and wherein the beading (22*f*) of the two limb sections projects to the inner side of the carrier profile cross-section.

14. Dry construction system according to claim 11, characterised in that a depth of the beading (22*f*) of the two limb sections amounts to one to six times the rated sheet thickness.

15. Dry construction system according to claim 1, characterised in that the embossing in the carrier profiles (22) is applied on both sides of the sheet material.

16. Dry construction system according to claim 1, wherein the limb sections (22*b*, 22*b*') have free ends and characterised in that the carrier profiles (22) at the free ends of the limb sections (22*b*, 22*b*') in each case comprise inclinations (22*d*) facing inwards.

17. Dry construction system according to claim 1, characterised in that a total thickness (D) derived from the embossing depth of the base section (22*a*) and of the limb sections (22*b*, 22*b*') respectively is 1.2 times to 3 times the rated sheet thickness.

18. Dry construction system according to claim 17, characterised in that a total thickness (D) derived from the embossing depth of the base section (22*a*) and of the limb sections (22*b*, 22*b*') respectively amounts to about 1.6 times the rated sheet thickness.

19. Carrier profile (22) for a dry construction system which is formed from a sheet material having a rated sheet thickness and in cross-section comprises a base section (22*a*) as well as two adjacent limb sections (22*b*, 22*b*') arranged perpendicular thereto, wherein the limb sections (22*b*, 22*b*') comprise an embossing with regularly distributed elevations and depressions, characterised in that the base section (22*a*) of the carrier profiles (22) also comprises an embossing with regularly distributed elevations on a first side and corresponding depressions on a second, opposite side, said elevations and depressions regularly distributed in an orthogonal array, so as to provide a pattern that repeats in two dimensions, that the centre-to-centre distance between two adjacent elevations of the embossing on the first side of the sheet material is between three and six times the rated sheet thickness, and that the base section (22*a*) is connected to the adjacent limb section (22*b*, 22*b*') in each case by a curved section (22*c*) with an outer radius (R1) which amounts to between three and ten times the rated sheet thickness.

* * * * *